US011811149B2

(12) United States Patent
Lin et al.

(10) Patent No.: US 11,811,149 B2
(45) Date of Patent: Nov. 7, 2023

(54) MULTI-BAND ANTENNA

(71) Applicant: Cheng Uei Precision Industry Co., LTD., New Taipei (TW)

(72) Inventors: Ming-Ju Lin, New Taipei (TW); Chih-Chung Wang, New Taipei (TW); Lan-Yung Hsiao, New Taipei (TW); Shao-Kai Sun, New Taipei (TW)

(73) Assignee: CHENG UEI PRECISION INDUSTRY CO., LTD., New Taipei (TW)

( * ) Notice: Subject to any disclaimer, the term of this patent is extended or adjusted under 35 U.S.C. 154(b) by 86 days.

(21) Appl. No.: 17/725,382

(22) Filed: Apr. 20, 2022

(65) Prior Publication Data

US 2022/0376393 A1 Nov. 24, 2022

(30) Foreign Application Priority Data

May 20, 2021 (CN) ..... 202121081400.1

(51) Int. Cl.
*H01Q 5/371* (2015.01)
*H01Q 9/04* (2006.01)

(52) U.S. Cl.
CPC ..... *H01Q 5/371* (2015.01); *H01Q 9/045* (2013.01); *H01Q 9/0421* (2013.01)

(58) Field of Classification Search
CPC ..... H01Q 5/371; H01Q 9/0421; H01Q 9/045; H01Q 1/48
See application file for complete search history.

(56) References Cited

U.S. PATENT DOCUMENTS

2011/0012789 A1* 1/2011 Yang ..... H01Q 5/371 343/700 MS
2015/0061939 A1* 3/2015 Chou ..... H01Q 1/243 343/700 MS

* cited by examiner

*Primary Examiner* — Dieu Hien T Duong
(74) *Attorney, Agent, or Firm* — Cheng-Ju Chiang

(57) ABSTRACT

A multi-band antenna includes a lower grounding portion, a feed-in portion, a feeding point, an upper grounding portion, a first extending portion, a second extending portion, a third extending portion, a fourth extending portion, a fifth extending portion, a first branch, a second branch, a third branch and a loop portion. The feed-in portion, the first extending portion, the second extending portion, the third extending portion, the fourth extending portion and the first branch form a first radiation portion. The feed-in portion, the first extending portion, the second extending portion, the third extending portion, the fifth extending portion and the second branch form a second radiation portion. The feed-in portion, the first extending portion, the second extending portion and the third branch form a third radiation portion.

20 Claims, 7 Drawing Sheets

Start 500MHz Pwr 0 dBm Stop 6GMz

| Band(MHz) | Frequency (MHz) | Efficiency (%) |
|---|---|---|
| 700 | 704-824 | 76.58 |
| 800 | 791-894 | 63.18 |
| 900 | 880-960 | 59.94 |
| 1800 | 1710-1890 | 67.09 |
| 1900 | 1845-1995 | 72.38 |
| 2100 | 1920-2170 | 56.19 |
| 2300 | 2300-2360 | 42.03 |
| 2600 | 2500-2690 | 54.43 |
| 3500 | 3300-3800 | 60.7 |
| 4500 | 4400-5000 | 52.95 |

FIG. 7

MULTI-BAND ANTENNA

CROSS-REFERENCE TO RELATED APPLICATION

The present application is based on, and claims priority from, China Patent Application No. 202121081400.1, filed May 20, 2021, the disclosure of which is hereby incorporated by reference herein in its entirety.

BACKGROUND OF THE INVENTION

1. Field of the Invention

The present invention generally relates to a multi-band antenna, and more particularly to a multi-band antenna increasing frequency bands in a finite volume condition.

2. The Related Art

With the vigorous development of the high technology communication industries, more and more mobile communication devices are widely used. Especially 5G (Fifth Generation Mobile Communication Technology) network becomes more and more popular. Due to a 5G development, a 5G NR (New Radio) frequency band, a 5G millimeter wave frequency band and a FR1 (Frequency Range 1) band have also appeared. Some frequency bands are also overlapped with a 4G (Fourth Generation Mobile Communication Technology) frequency band. Thus, a multi-band antenna demand of the mobile communication device is requested higher and higher. The mobile communication device is a cell phone.

However, because of market trends, antennas of the mobile communication devices are all received in housings of the mobile communication devices. Therefore, the antennas are limited by spaces of the housings. Moreover, a small planar inverted-F antenna (PIFA) is used as the antenna of the cell phone, so it is difficult to increase an application bandwidth under a certain antenna area condition. As a result, it has no way of satisfying the multi-band antenna demand of the mobile communication device in compliance with 4G and 5G.

Thus, it is essential to provide an innovative multi-band antenna increasing frequency bands in a finite volume condition.

SUMMARY OF THE INVENTION

An object of the present invention is to provide a multi-band antenna. The multi-band antenna includes a lower grounding portion, a feed-in portion, a feeding point, an upper grounding portion, a first extending portion, a second extending portion, a third extending portion, a fourth extending portion, a fifth extending portion, a first branch, a second branch, a third branch and a loop portion. The feed-in portion has a first end edge, a second end edge opposite to the first end edge, a first side edge, and a second side edge opposite to the first side edge. The first side edge is adjacent to the lower grounding portion. The first side edge is spaced from the lower grounding portion. The feeding point is disposed to the feed-in portion. The feeding point is adjacent to the first side edge. The upper grounding portion is extended frontward from the first end edge of the feed-in portion. The upper grounding portion is electrically connected between the feed-in portion and the lower grounding portion. The first extending portion is extended rearward from the second end edge of the feed-in portion. The second extending portion is extended upward from a distal end of the first extending portion. The third extending portion is extended frontward from a distal end of the second extending portion. The fourth extending portion is extended upward from a distal end of the third extending portion. The fifth extending portion is extended frontward from the distal end of the third extending portion. The first branch is extended frontward from a front of the fourth extending portion. A rear of the first branch is located above the fifth extending portion. The second branch is extended frontward from an upper portion of a distal end of the fifth extending portion. The first branch and the second branch are extended from one end of the feed-in portion. The first branch and the second branch are located at the same end of the feed-in portion. The third branch is extended upward from the distal end of the second extending portion. The third branch is located at the other end of the feed-in portion. The loop portion is extended from a lower portion of the distal end of the fifth extending portion. A lower end of the loop portion is connected with the first end edge of the feed-in portion. An upper end of the loop portion is connected with the fifth extending portion. The loop portion is positioned under the fifth extending portion. The first branch, the second branch and the third branch are positioned at the same side of the feed-in portion. The loop portion, the first branch and the second branch are located at the same end of the feed-in portion.

Another object of the present invention is to provide a multi-band antenna. The multi-band antenna includes a lower grounding portion, a feed-in portion, a feeding point, an upper grounding portion, a first extending portion, a second extending portion, a third extending portion, a fourth extending portion, a fifth extending portion, a first branch, a second branch, a third branch and a loop portion. The feed-in portion has a first end edge, a second end edge opposite to the first end edge, a first side edge, and a second side edge opposite to the first side edge. The first side edge is adjacent to the lower grounding portion. The first side edge is spaced from the lower grounding portion. The feeding point is disposed to the feed-in portion. The feeding point is adjacent to the first side edge. A lower portion of the first end edge of the feed-in portion extends frontward to form the upper grounding portion. The upper grounding portion is electrically connected between the feed-in portion and the lower grounding portion. An upper portion of the second end edge of the feed-in portion extends rearward to form the first extending portion. A rear end of the first extending portion extends upward to form the second extending portion. An upper portion of a front of the second extending portion extends frontward to form the third extending portion. A front end of the third extending portion extends upward to form the fourth extending portion. The front end of the third extending portion extends frontward to form the fifth extending portion. An upper portion of a front of the fourth extending portion extends frontward to form the first branch. An upper portion of a front of the fifth extending portion extends frontward to form the second branch. A top of the second extending portion extends upward, and then extends along a transverse direction to form the third branch. A lower portion of the front of the fifth extending portion extends frontward, then extends downward, and further meanders rearward to form the loop portion. A lower end of the loop portion is connected with the first end edge of the feed-in portion. The feed-in portion, the first extending portion, the second extending portion, the third extending portion, the fourth extending portion and the first branch form a first radiation portion. The feed-in portion, the first extending portion, the second extending portion, the third extending portion, the fifth extending portion and the second branch form a second radiation portion. The feed-in portion, the first extending portion, the second extending portion and the third branch form a third radiation portion.

Another object of the present invention is to provide a multi-band antenna. The multi-band antenna includes a lower grounding portion, a feed-in portion, a feeding point, an upper grounding portion, a first extending portion, a second extending portion, a third extending portion, a fourth extending portion, a fifth extending portion, a first branch, a second branch, a third branch and a loop portion. The feed-in portion extends along a transverse direction. The feed-in portion is spaced from the lower grounding portion. The feeding point is disposed to the feed-in portion. The upper grounding portion is electrically connected between the feed-in portion and the lower grounding portion. The first extending portion is extended from one edge of the feed-in portion. The second extending portion is extended from the first extending portion. The third extending portion is extended from the second extending portion. The fourth extending portion is extended from the third extending portion. The fifth extending portion is extended from the third extending portion. The first branch is extended from the fourth extending portion. The second branch is extended from the fifth extending portion. The third branch is extended from the second extending portion. The loop portion is connected between the fifth extending portion and the feed-in portion. The feed-in portion, the first extending portion, the second extending portion, the third extending portion, the fourth extending portion and the first branch form a first radiation portion. The feed-in portion, the first extending portion, the second extending portion, the third extending portion, the fifth extending portion and the second branch form a second radiation portion. The feed-in portion, the first extending portion, the second extending portion and the third branch form a third radiation portion.

As described above, the multi-band antenna feeds an electrical signal through the feeding point, a frequency bandwidth of the first radiation portion is ranged between 698 MHz and 960 MHz, a frequency bandwidth of the second radiation portion is ranged between 2300 MHz and 2600 MHz, a frequency bandwidth of the third radiation portion is ranged between 3300 MHz and 5000 MHz, the loop portion is used for increasing a lower frequency bandwidth of the first radiation portion. As a result, the multi-band antenna can increase the frequency bandwidths in a finite volume to appropriate for a miniaturization development trend of an electronic product which includes the multi-band antenna.

BRIEF DESCRIPTION OF THE DRAWINGS

The present invention will be apparent to those skilled in the art by reading the following description, with reference to the attached drawings, in which:

FIG. 7 is a test table of the multi-band antenna of FIG. 1.

DETAILED DESCRIPTION OF THE PREFERRED EMBODIMENT

Figure 1:
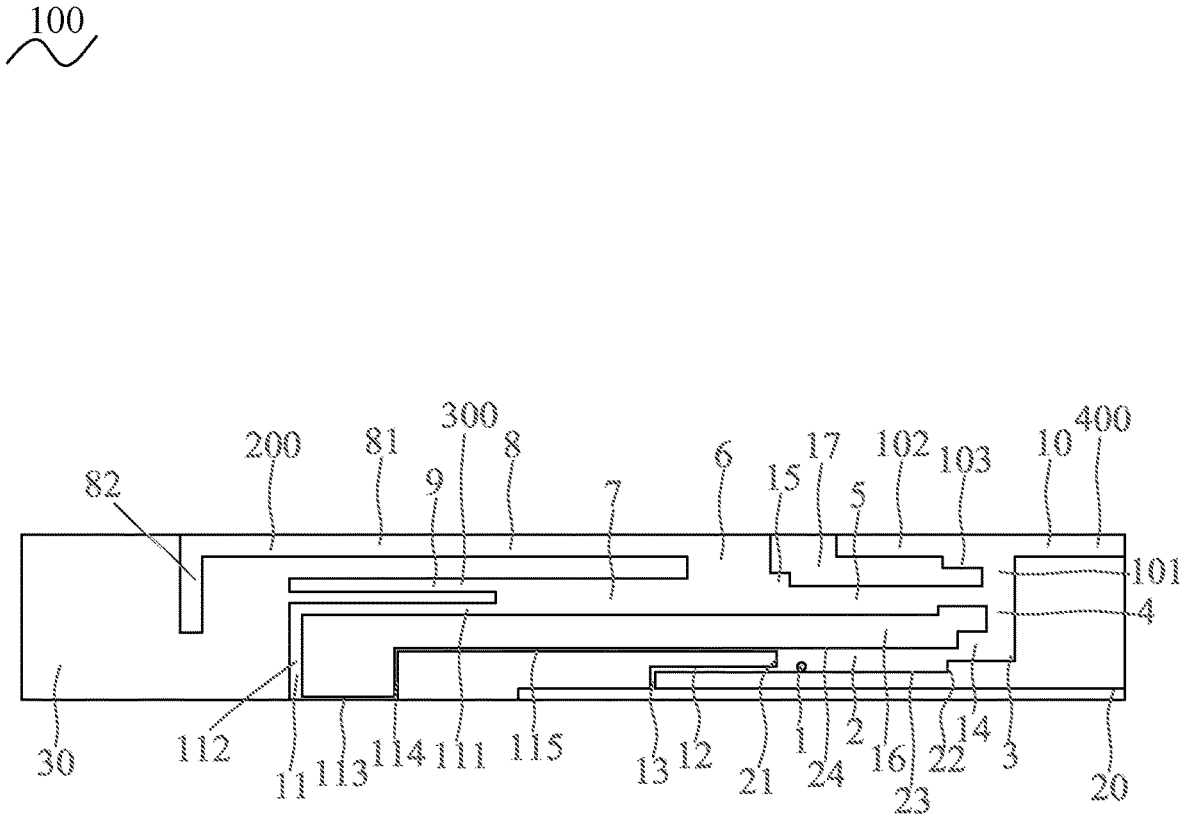
FIG. 1 is a diagrammatic drawing of a multi-band antenna in accordance with a preferred embodiment of the present invention.

With reference to FIG. 1 to FIG. 6, a multi-band antenna 100 in accordance with a preferred embodiment of the present invention is shown. The multi-band antenna 100 is a planar inverted-F antenna (PIFA). The multi-band antenna 100 includes a feeding point 1, a feed-in portion 2, a first extending portion 3, a second extending portion 4, a third extending portion 5, a fourth extending portion 6, a fifth extending portion 7, a first branch 8, a second branch 9, a third branch 10, a loop portion 11, an upper grounding portion 12 and a lower grounding portion 20. The multi-band antenna 100 is disposed on a circuit board 30. The multi-band antenna 100 is formed at the circuit board 30. The circuit board 30 is one of a rigid printed circuit board, a flexible circuit board, a rigid-flex printed circuit board, a ceramic circuit board and etc. The circuit board 30 includes a dielectric substrate or a ceramic substrate.

The feeding point 1 is disposed to one side of the feed-in portion 2. A current is fed into a lower portion of the feed-in portion 2 from the feeding point 1. The feed-in portion 2 is a rectangular plate shape. The feed-in portion 2 extends along a transverse direction. The lower grounding portion 20 is an elongated rectangle plate shape. The lower grounding portion 20 is located under the feed-in portion 2. The feed-in portion 2 is parallel to the lower grounding portion 20. The upper grounding portion 12 is a strip shape, and the upper grounding portion 12 is electrically connected between the feed-in portion 2 and the lower grounding portion 20.

The feed-in portion 2 has a first end edge 21, a second end edge 22 opposite to the first end edge 21, a first side edge 23, and a second side edge 24 opposite to the first side edge 23. The first side edge 23 of the feed-in portion 2 faces to the lower grounding portion 20. The first side edge 23 of the feed-in portion 2 is adjacent to the lower grounding portion 20. The first side edge 23 of the feed-in portion 2 is spaced from the lower grounding portion 20. The feeding point 1 is adjacent to the first side edge 23 of the feed-in portion 2. An upper portion of the first end edge 21 of the feed-in portion 2 is connected with the loop portion 11. A lower portion of the first end edge 21 of the feed-in portion 2 is connected with the upper grounding portion 12. One end of the upper grounding portion 12 is connected with the lower portion of the first end edge 21 of the feed-in portion 2, and the other end of the upper grounding portion 12 is electrically connected to the lower grounding portion 20 through the connecting portion 13. A rear end of the upper grounding portion 12 is connected with the lower portion of the first end edge 21 of the feed-in portion 2. The lower portion of the first end edge 21 of the feed-in portion 2 extends frontward to form the upper grounding portion 12. An upper portion of the second end edge 22 of the feed-in portion 2 is connected with the first extending portion 3. The upper portion of the second end edge 22 of the feed-in portion 2 extends rearward to form the first extending portion 3. An extending direction of the first extending portion 3 is opposite to an extending direction of the upper grounding portion 12.

The upper grounding portion 12 is parallel to the lower grounding portion 20. In the preferred embodiment, the upper grounding portion 12 is located among the feed-in portion 2, the loop portion 11 and the lower grounding portion 20. The other end of the upper grounding portion 12 extends downward to form a connecting portion 13. A front end of the upper grounding portion 12 extends downward to form the connecting portion 13. A bottom end of the connecting portion 13 is connected with the lower grounding portion 20, and a top end of the connecting portion 13 is connected with the upper grounding portion 12. The connecting portion 13 is a short narrow rectangle plate shape. The connecting portion 13 is perpendicular to the upper grounding portion 12. The connecting portion 13 is perpendicular to the lower grounding portion 20.

In the preferred embodiment, the upper grounding portion 12 is extended frontward from the first end edge 21 of the feed-in portion 2. The upper grounding portion 12 is connected with the lower grounding portion 20 by the connecting portion 13. The upper grounding portion 12 is electrically connected between the feed-in portion 2 and the lower grounding portion 20. The first extending portion 3 is extended from one edge of the feed-in portion 2. The first extending portion 3 is extended rearward from the second end edge 22 of the feed-in portion 2. The second extending portion 4 is extended upward from a distal end of the first extending portion 3. The third extending portion 5 is extended frontward from a distal end of the second extending portion 4. The fourth extending portion 6 is extended upward from a distal end of the third extending portion 5. The fifth extending portion 7 is extended frontward from the distal end of the third extending portion 5. The first branch 8 is extended frontward from a front of the fourth extending portion 6. A rear of the first branch 8 is located above the fifth extending portion 7. The second branch 9 is extended frontward from an upper portion of a distal end of the fifth extending portion 7. The loop portion 11 is connected between the fifth extending portion 7 and the feed-in portion 2. The first branch 8 and the second branch 9 are located at the same end of the feed-in portion 2. The third branch 10 is extended upward from the distal end of the second extending portion 4. The third branch 10 is located at the other end of the feed-in portion 2. The first branch 8, the second branch 9 and the third branch 10 are positioned at the same side of the feed-in portion 2. The loop portion 11 is extended from a lower portion of the distal end of the fifth extending portion 7. The loop portion 11 is an orthogon shape. One end of the loop portion 11 is connected to the lower portion of the distal end of the fifth extending portion 7, and the other end of the loop portion 11 is connected to the upper portion of the first end edge 21 of the feed-in portion 2. A lower end of the loop portion 11 is connected with the first end edge 21 of the feed-in portion 2. An upper end of the loop portion 11 is connected with the fifth extending portion 7. The loop portion 11 is positioned under the fifth extending portion 7. A distal end of the loop portion 11 is connected with the first end edge 21 of the feed-in portion 2. The loop portion 11, the first branch 8 and the second branch 9 are located at the same end of the feed-in portion 2.

The other end of the feed-in portion 2 is connected with the first extending portion 3. The other end of the feed-in portion 2 extends rearward to form the first extending portion 3. The second end edge 22 of the feed-in portion 2 is connected with the first extending portion 3. The second end edge 22 of the feed-in portion 2 extends rearward to form the first extending portion 3. The first extending portion 3 and the lower grounding portion 20 are spaced from each other. The first extending portion 3 is parallel to the lower grounding portion 20. A front end of the first extending portion 3 is connected with the feed-in portion 2. A rear end of the first extending portion 3 is connected with the second extending portion 4. The rear end of the first extending portion 3 extends upward to form the second extending portion 4. A junction between the first extending portion 3 and the second extending portion 4 protrudes upward and frontward to form a first protruding portion 14. The first protruding portion 14 is located between a top of the first extending portion 3 and a front of the second extending portion 4.

A bottom of the second extending portion 4 is located above the lower grounding portion 20. The bottom of the second extending portion 4 is spaced from the lower grounding portion 20. The second extending portion 4 is perpendicular to the first extending portion 3. The bottom of the second extending portion 4 is connected with the rear end of the first extending portion 3. A top of the second extending portion 4 is connected with the third branch 10. An upper portion of the front of the second extending portion 4 is connected with the third extending portion 5. The upper portion of the front of the second extending portion 4 extends frontward to form the third extending portion 5.

The front of the second extending portion 4, a bottom of the third extending portion 5, a top of the first protruding portion 14 and the second side edge 24 of the feed-in portion 2 surround a first interval 16. In other words, the first interval 16 is located among the feed-in portion 2, the first extending portion 3, the second extending portion 4, the third extending portion 5 and the first protruding portion 14.

The third extending portion 5 is parallel to the feed-in portion 2, the first extending portion 3 and the lower grounding portion 20. A rear end of the third extending portion 5 is connected with the upper portion of the front of the second extending portion 4. A front end of the third extending portion 5 is connected with the fourth extending portion 6. The front end of the third extending portion 5 extends upward to form the fourth extending portion 6. In the preferred embodiment, a topmost edge of the second extending portion 4 is flush with a topmost edge of the third extending portion 5. A topmost edge of the fifth extending portion 7 is flush with a topmost edge of the second branch 9.

A lower portion of the fourth extending portion 6 is connected with the third extending portion 5. The front end of the third extending portion 5 is connected with the fifth extending portion 7. The front end of the third extending portion 5 extends frontward to form the fifth extending portion 7. An upper portion of the front of the fourth extending portion 6 is connected with the first branch 8. The upper portion of the front of the fourth extending portion 6 extends frontward to form the first branch 8. A junction between the third extending portion 5 and the fourth extending portion 6 protrudes upward and rearward to form a second protruding portion 15. The second protruding portion 15 is located between a top edge of the third extending portion 5 and a rear edge of the fourth extending portion 6. A topmost edge of the fourth extending portion 6 is flush with a topmost edge of the first branch 8.

A rear of the fifth extending portion 7 is connected with the third extending portion 5 and the fourth extending portion 6. A lowest edge of the fifth extending portion 7 is flush with a lowest edge of the third extending portion 5. The fifth extending portion 7 is parallel to the feed-in portion 2, the first extending portion 3, a rear of the first branch 8 and the lower grounding portion 20. An upper portion of a front of the fifth extending portion 7 is connected with the second branch 9. The upper portion of the front of the fifth extending portion 7 extends frontward to form the second branch 9. A lower portion of the front of the fifth extending portion 7 is connected with the upper end of the loop portion 11. The lower portion of the front of the fifth extending portion 7 extends frontward, then extends downward, and further meanders rearward to form the loop portion 11.

The top edge of the third extending portion 5, the rear edge of the fourth extending portion 6, the second protruding portion 15 and the third branch 10 surround a second interval 17. In other words, the second interval 17 is located among the third extending portion 5, the fourth extending portion 6, the second protruding portion 15 and the third branch 10.

A rear of the first branch 8 is connected with the upper portion of the front of the fourth extending portion 6. An upper portion of the first branch 8 is parallel to the feed-in portion 2 and the lower grounding portion 20. The first branch 8 has a first transverse portion 81 and a first upright portion 82. The upper portion of the front of the fourth extending portion 6 extends frontward to form the first transverse portion 81. A rear end of the first transverse portion 81 is connected with the upper portion of the front of the fourth extending portion 6. A front end of the first transverse portion 81 extends downward to form the first upright portion 82. A bottom end of the first upright portion 82 is free. An extending direction of the first upright portion 82 and an extending direction of the second branch 9 are perpendicular to each other. The first upright portion 82 and the second branch 9 are spaced from each other.

In the preferred embodiment, the feed-in portion 2, the first extending portion 3, the second extending portion 4, the third extending portion 5, the fourth extending portion 6 and the first branch 8 form a first radiation portion 200 of the multi-band antenna 100.

When the multi-band antenna 100 is used in a wireless communication, the current is fed into the feed-in portion 2 through the feeding point 1, the current passes through the feed-in portion 2 of the first radiation portion 200, a frequency bandwidth of the first radiation portion 200 is ranged between 698 MHz-960 MHz in an oscillation. In the concrete implementation, a length of the upper grounding portion 12 is adjustable. When the length of the upper grounding portion 12 is changed, the frequency bandwidth which is ranged between 698 MHz and 960 MHz is adjustable.

When the multi-band antenna 100 is used in the wireless communication, the current is fed into the feed-in portion 2 through the feeding point 1, the current passes through the feed-in portion 2, the first extending portion 3, the second extending portion 4, the third extending portion 5 and fourth extending portion 6 to radiate a frequency bandwidth ranged between 1710 MHz and 2300 MHz. A width of the first interval 16 and a width of the second interval 17 are adjustable. In the oscillation, the frequency bandwidth of the first radiation portion 200 which is ranged between 1710 MHz and 2300 MHz is adjustable by virtue of adjusting the width of the first interval 16 and the width of the second interval 17. In the concrete implementation, the frequency bandwidth is changeable by virtue of adjusting the width of the first interval 16 and the width of the second interval 17.

A rear end of the second branch 9 is connected with the upper portion of the front of the fifth extending portion 7. The upper portion of the front of the fifth extending portion 7 extends frontward to form the second branch 9. The second branch 9 is parallel to the feed-in portion 2 and the lower grounding portion 20. The second branch 9 is a rectangular bar shape and extends along the transverse direction. The second branch 9 is located among the first transverse portion 81 and the first upright portion 82 of the first branch 8, the fifth extending portion 7 and the loop portion 11. The first branch 8 and the second branch 9 are extended from one end of the feed-in portion 2. The first branch 8 and the second branch 9 are located at the same end of the feed-in portion 2. The first branch 8 and the second branch 9 are located at the same side of the feed-in portion 2. A front end of the second branch 9 is free.

In the preferred embodiment, the feed-in portion 2, the first extending portion 3, the second extending portion 4, the third extending portion 5, the fifth extending portion 7 and the second branch 9 form a second radiation portion 300 of the multi-band antenna 100.

When the multi-band antenna 100 is used in the wireless communication, the current is fed into the feed-in portion 2 through the feeding point 1, the current passes through the feed-in portion 2 of the second radiation portion 300, a frequency bandwidth of the second radiation portion 300 is ranged between 2300 MHz and 2600 MHz in the oscillation. In the concrete implementation, when the length of the upper grounding portion 12 is changed, the frequency bandwidth which is ranged between 2300 MHz and 2600 MHz is adjustable. When the first radiation portion 200 and the second radiation portion 300 are resonated, a resonated frequency bandwidth which is ranged between 3300 MHz and 3800 MHz is generated.

A bottom of the third branch 10 is connected with the top of the second extending portion 4. The top of the second extending portion 4 extends upward, and then extends along the transverse direction to form the third branch 10. An upper portion of the third branch 10 is parallel to the feed-in portion 2 and the lower grounding portion 20. The third branch 10 is a T shape. The third branch 10 is located at the other end of the feed-in portion 2. The third branch 10, the second extending portion 4, the third extending portion 5, the fourth extending portion 6, the fifth extending portion 7, the first branch 8 and the second branch 9 are located at the same side of the feed-in portion 2. In the preferred embodiment, a top edge of the third branch 10 is in alignment with the topmost edge of the first branch 8.

The third branch 10 has a second upright portion 101, a second transverse portion 102 and a linking portion 103. The top of the second extending portion 4 extends upward to form the second upright portion 101. A bottom of the second upright portion 101 is connected with the top of the second extending portion 4. A top of the second upright portion 101 extends along the transverse direction to form the second transverse portion 102. A rear edge of the second transverse portion 102 is in alignment with a rear edge of the lower grounding portion 20. A front of the second transverse portion 102 is spaced from the fourth extending portion 6. A bottom edge of the second transverse portion 102 is spaced from the third extending portion 5. A junction between a front edge of the second upright portion 101 and the bottom edge of the second transverse portion 102 protrudes frontward and downward to form the linking portion 103. The linking portion 103 projects beyond the front edge of the second upright portion 101 and the bottom edge of the second transverse portion 102. The second upright portion 101 is connected with a middle of the bottom edge of the second transverse portion 102.

In the preferred embodiment, the feed-in portion 2, the first extending portion 3, the second extending portion 4 and the third branch 10 form a third radiation portion 400 of the multi-band antenna 100.

When the multi-band antenna 100 is used in the wireless communication, the current is fed into the feed-in portion 2 through the feeding point 1, the current passes through the feed-in portion 2 of the third radiation portion 400, a frequency bandwidth of the third radiation portion 400 is ranged between 3300 MHz and 5000 MHz in the oscillation. In the concrete implementation, when the length of the upper grounding portion 12 is changed, the frequency bandwidth which is ranged between 3300 MHz and 5000 MHz is adjustable.

The loop portion 11 is used for increasing a lower frequency bandwidth of the first radiation portion 200. The loop portion 11, the first branch 8 and the second branch 9 are extended from the same side of the feed-in portion 2. The loop portion 11 has a first section 111, a second section 112, a third section 113, a fourth section 114 and a fifth section 115. The first section 111, the second section 112, the third section 113, the fourth section 114 and the fifth section 115 are rectangular. The lower portion of the front of the fifth extending portion 7 extends frontward to form the first section 111. A rear end of the first section 111 is connected with the lower portion of the front of the fifth extending portion 7.

A front end of the first section 111 is connected with a top end of the second section 112. The front end of the first section 111 extends downward to form the second section 112. The second section 112 is perpendicular to the first section 111.

A bottom end of the second section 112 is connected with the third section 113. The bottom end of the second section 112 extends rearward to form the third section 113. The third section 113 is perpendicular to the second section 112. The third section 113 is parallel to the first section 111. A front edge of the second section 112 is in alignment with a front edge of the second branch 9.

A rear end of the third section 113 is connected with the fourth section 114. The rear end of the third section 113 extends upward to form the fourth section 114. The fourth section 114 is perpendicular to the third section 113. The fourth section 114 is parallel to the second section 112. The fourth section 114 is spaced from a front end of the lower grounding portion 20. A position of the fourth section 114 is substantially in alignment with a middle of the first section 111, a middle of the second branch 9 and a middle of the first branch 8.

A top end of the fourth section 114 is connected with the fifth section 115. The top end of the fourth section 114 extends rearward to form the fifth section 115. A rear end of the fifth section 115 is connected with the feed-in portion 2. More specifically, the rear end of the fifth section 115 is connected with the upper portion of the first end edge 21 of the feed-in portion 2. The fifth section 115 is perpendicular to the fourth section 114. The fifth section 115 is parallel to the third section 113 and the first section 111. A top edge of the fifth section 115 is flush with the second side 24 of the feed-in portion 2.

In the preferred embodiment, a length of the fifth section 115 is the longest in the loop portion 11. A length of the first section 111 is longer than a length of the third section 113. The length of the third section 113 is longer than a length of the second section 112. The length of the second section 112 is longer than a length of the fourth section 114.

In the preferred embodiment, a width of the first section 111 and a width of the second section 112 are the same. A width of the third section 113, a width of the fourth section 114 and a width of the fifth section 115 are the same. The width of the first section 111 is wider than the width of the third section 113.

In the preferred embodiment, a front edge of the first section 111 of the loop portion 11 is in alignment with the front edge of the second branch 9. A bottom edge of the third section 113 of the loop portion 11 is in alignment with a bottom edge of the lower grounding portion 20. When an inner space surrounded by the first section 111, the second section 112, the third section 113, the fourth section 114 and the fifth section 115 of the loop portion 11 is adjusted, the lower frequency bandwidth of the first radiation portion 200 is changeable. When the length of the first section 111, the length of the second section 112, the length of the third section 113, the length of the fourth section 114 and the length of the fifth section 115 of the loop portion 11 are adjusted, the frequency bandwidth of the second radiation portion 300 is changeable. The concrete implementation is without being limited to the above-mentioned description.

In the preferred embodiment, the frequency bandwidth of the first radiation portion 200 is ranged between 698 MHz and 960 MHz. The frequency bandwidth of the second radiation portion 300 is ranged between 2300 MHz and 2600 MHz. The frequency bandwidth of the third radiation portion 400 is ranged between 3300 MHz and 5000 MHz. Thus, the multi-band antenna 100 increases the frequency bandwidths in a finite volume.

In the preferred embodiment, an extending length of the first radiation portion 200 is longer than an extending length of the second radiation portion 300. The extending length of the second radiation portion 300 is longer than an extending length of the loop portion 11. The extending length of the loop portion 11 is longer than an extending length of the third radiation portion 400.

Figure 2:
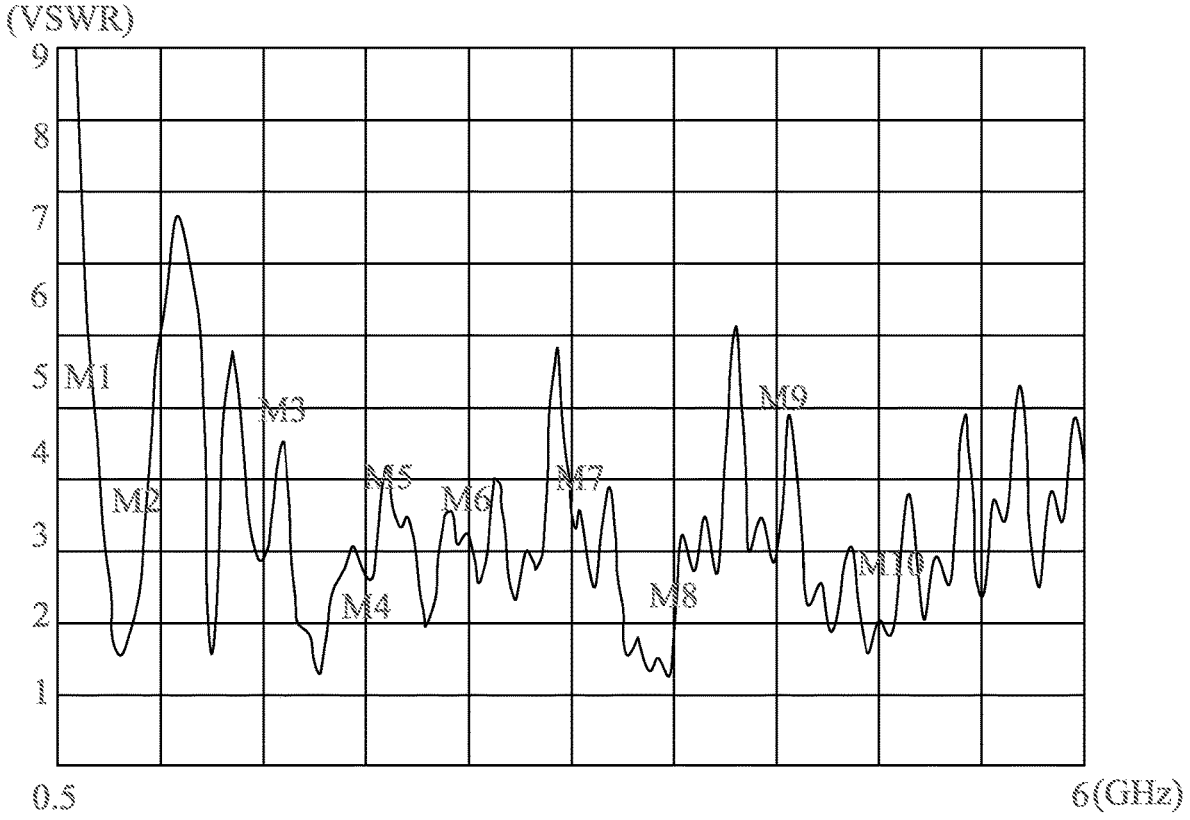
FIG. 2 is a test chart of a Voltage Standing Wave Ratio (VSWR) of the multi-band antenna of FIG. 1.
Figure 3:
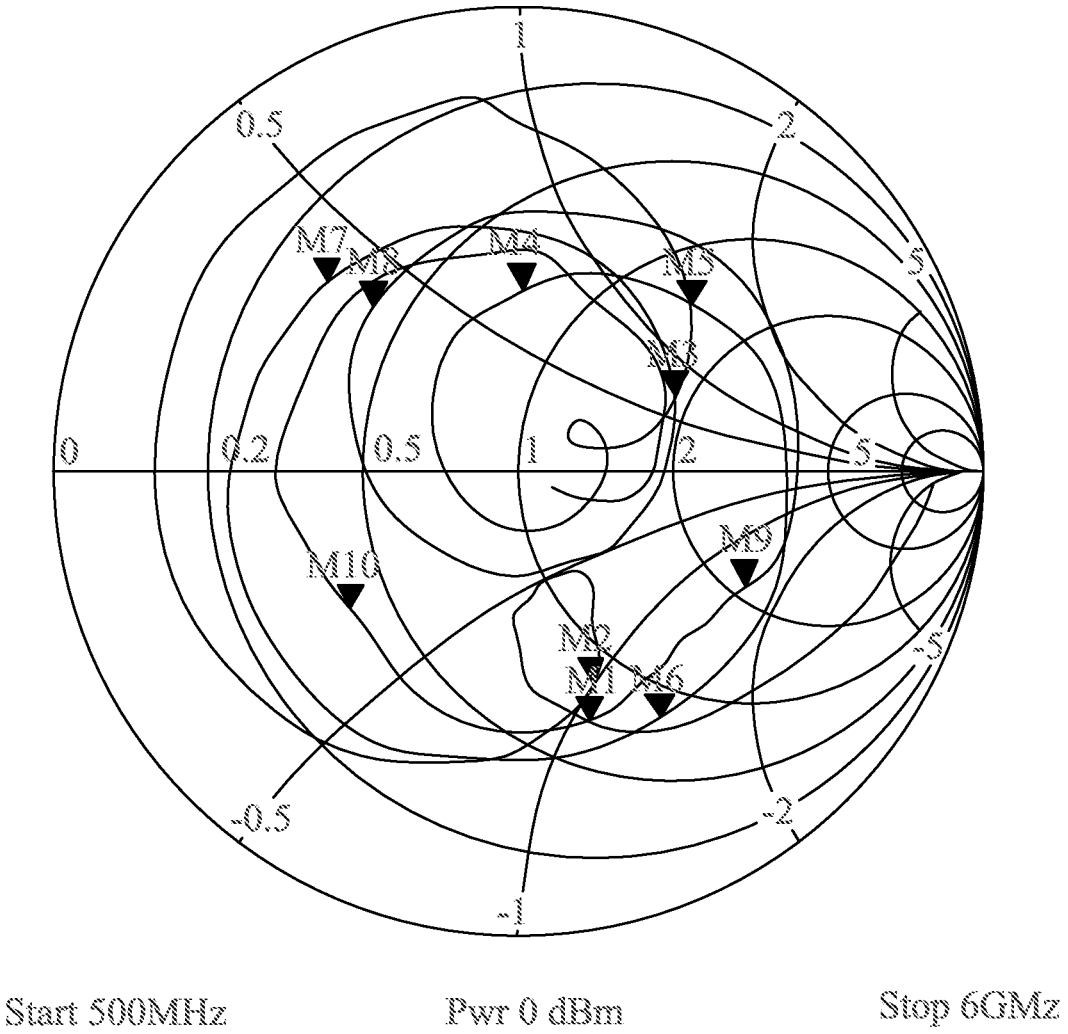
FIG. 3 is a Smith Chart of the multi-band antenna of FIG. 1.

Referring to FIG. 1, FIG. 2 and FIG. 3, a VSWR (Voltage Standing Wave Ratio) test chart of the multi-band antenna 100 is shown in FIG. 2. A Smith chart of the multi-band antenna 100 is shown in FIG. 3. When the multi-band antenna 100 is operated at 698 MHz, a voltage standing wave ratio value is 4.8253 shown at a point M1 of FIG. 2. When the multi-band antenna 100 is operated at 960 MHz, the voltage standing wave ratio value is 3.1055 shown at a point M2 of FIG. 2. When the multi-band antenna 100 is operated at 1710 MHz, the voltage standing wave ratio value is 4.4755 shown at a point M3 of FIG. 2. When the multi-band antenna 100 is operated at 2170 MHz, the voltage standing wave ratio value is 2.4888 shown at a point M4 of FIG. 2. When the multi-band antenna 100 is operated at 2300 MHz, the voltage standing wave ratio value is 3.5983 shown at a point M5 of FIG. 2. When the multi-band antenna 100 is operated at 2690 MHz, the voltage standing wave ratio value is 3.2337 shown at a point M6 of FIG. 2. When the multi-band antenna 100 is operated at 3300 MHz, the voltage standing wave ratio value is 3.3867 shown at a point M7 of FIG. 2. When the multi-band antenna 100 is operated at 3800 MHz, the voltage standing wave ratio value is 1.7486 shown at a point M8 of FIG. 2. When the multi-band antenna 100 is operated at 4400 MHz, the voltage standing wave ratio value is 4.5314 shown at a point M9 of FIG. 2. When the multi-band antenna 100 is operated at 5000 MHz, the voltage standing wave ratio value is 2.3172 shown at a point M10 of FIG. 2. Thus, the multi-band antenna 100 is able to be operated stably at the frequency bandwidth which is ranged between 698 MHz and 960 MHz, the frequency bandwidth which is ranged between 2300 MHz and 2600 MHz, and the frequency bandwidth which is ranged between 3300 MHz and 5000 MHz.

Figure 4:
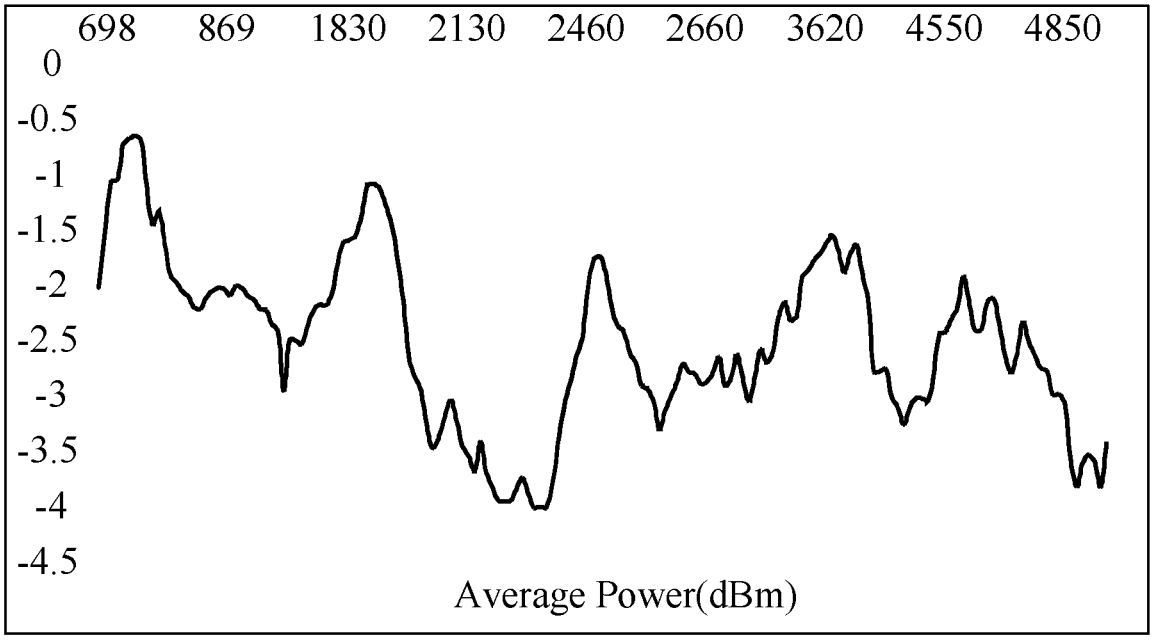
FIG. 4 is an average power chart of the multi-band antenna of FIG. 1.

Referring to FIG. 1 and FIG. 4, an average power chart of the multi-band antenna 100 is shown in FIG. 4. A loss degree of the multi-band antenna 100 is shown. When average power is higher, a loss of the multi-band antenna 100 is smaller. Make a radiation energy of the multi-band antenna 100 becomes larger, so that a radiation energy of the multi-band antenna 100 becomes larger. In the preferred embodiment, the average power of a lower frequency bandwidth is within −3 dBm.

Figure 5:
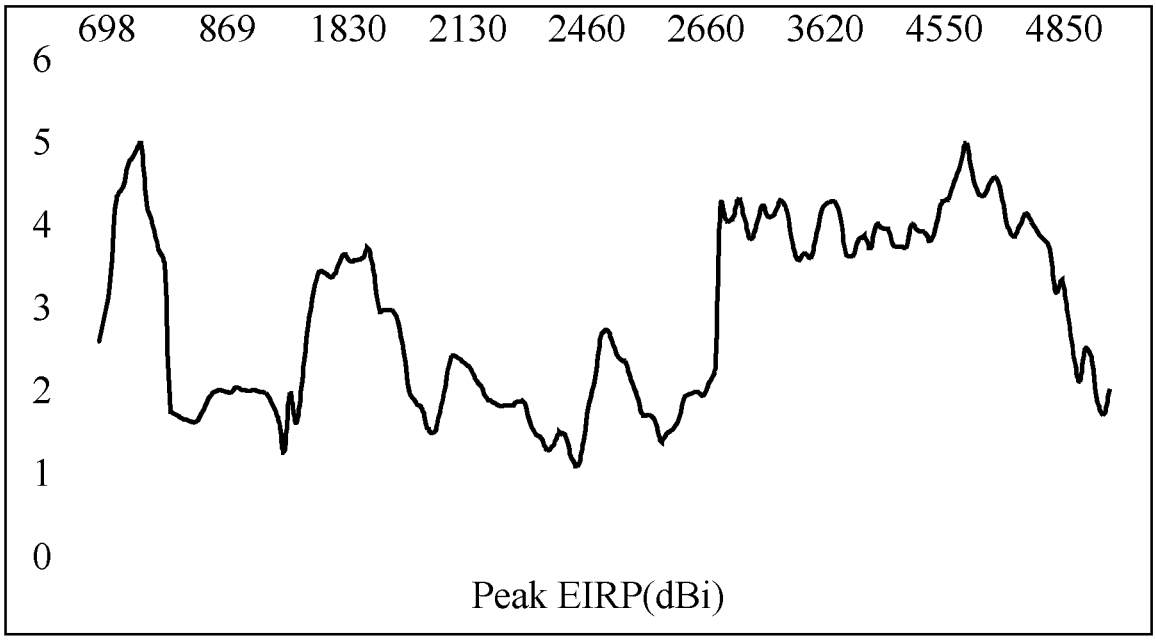
FIG. 5 is an equivalent isotropic radiated power (EIRP) chart of the multi-band antenna of FIG. 1.

Referring to FIG. 1 and FIG. 5, a peak equivalent isotropic radiated power (EIRP) chart of the multi-band antenna 100 is shown in FIG. 5. A maximum value of each frequency radiation of the multi-band antenna 100 is shown in the peak equivalent isotropic radiated power (EIRP) chart of the multi-band antenna 100. In the preferred embodiment, if peak values of equivalent isotropic radiated power in a whole frequency bandwidth are within the same range, power of the multi-band antenna 100 is stable.

Figure 6:
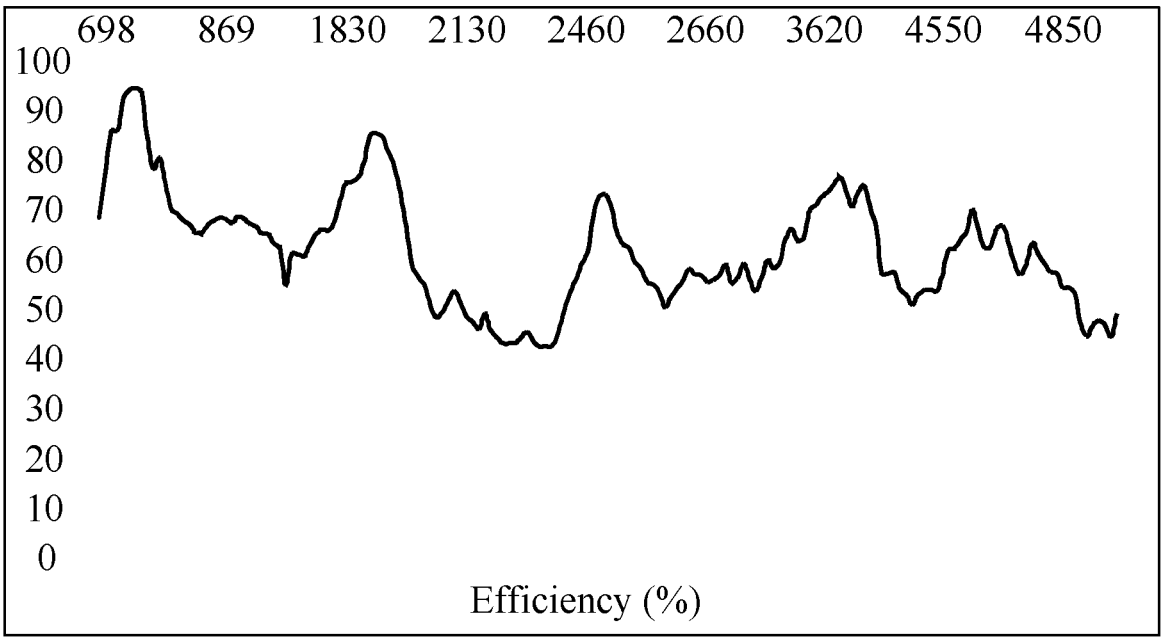
FIG. 6 is an efficiency chart of the multi-band antenna of FIG. 1.

Referring to FIG. 1, FIG. 6 and FIG. 7, an efficiency chart of the multi-band antenna 100 is shown in FIG. 6, and a test table shown in FIG. 7 is a data sheet of the multi-band antenna 100. The multi-band antenna 100 of FIG. 6 shows that the average power is converted into a radiation efficiency of the multi-band antenna 100. In different frequencies, the higher the efficiency value is, the better the frequency is. In the whole frequency bandwidth, the lower frequency bandwidths are more than fifth percent. Thus, the multi-band antenna 100 achieves the higher efficiency value of each lower frequency bandwidth in the finite volume, and the multi-band antenna 100 keeps the higher frequency bandwidths and the efficiency value of each higher frequency bandwidth.

As described above, the multi-band antenna 100 feeds an electrical signal through the feeding point 1, the frequency bandwidth of the first radiation portion 200 is ranged between 698 MHz and 960 MHz, the frequency bandwidth of the second radiation portion 300 is ranged between 2300 MHz and 2600 MHz, the frequency bandwidth of the third radiation portion 400 is ranged between 3300 MHz and 5000 MHz, the loop portion 11 is used for increasing the lower frequency bandwidth of the first radiation portion 200. As a result, the multi-band antenna 100 can increase the frequency bandwidths in the finite volume to appropriate for a miniaturization development trend of an electronic product which includes the multi-band antenna 100.

What is claimed is:

1. A multi-band antenna, comprising:

a lower grounding portion;

a feed-in portion having a first end edge, a second end edge opposite to the first end edge, a first side edge, and a second side edge opposite to the first side edge, the first side edge being adjacent to the lower grounding portion, the first side edge being spaced from the lower grounding portion;

a feeding point disposed to the feed-in portion, the feeding point being adjacent to the first side edge;

an upper grounding portion extended frontward from the first end edge of the feed-in portion, the upper grounding portion being electrically connected between the feed-in portion and the lower grounding portion;

a first extending portion extended rearward from the second end edge of the feed-in portion;

a second extending portion extended upward from a distal end of the first extending portion;

a third extending portion extended frontward from a distal end of the second extending portion;

a fourth extending portion extended upward from a distal end of the third extending portion;

a fifth extending portion extended frontward from the distal end of the third extending portion;

a first branch extended frontward from a front of the fourth extending portion, a rear of the first branch being located above the fifth extending portion;

a second branch extended frontward from an upper portion of a distal end of the fifth extending portion, the first branch and the second branch being extended from one end of the feed-in portion, the first branch and the second branch being located at the same end of the feed-in portion;

a third branch extended upward from the distal end of the second extending portion, the third branch being located at the other end of the feed-in portion; and a loop portion extended from a lower portion of the distal end of the fifth extending portion, a lower end of the loop portion being connected with the first end edge of the feed-in portion, an upper end of the loop portion being connected with the fifth extending portion, the loop portion being positioned under the fifth extending portion, the first branch, the second branch and the third branch being positioned at the same side of the feed-in portion, the loop portion, the first branch and the second branch being located at the same end of the feed-in portion.

2. The multi-band antenna as claimed in claim 1, wherein the feed-in portion, the first extending portion, the second extending portion, the third extending portion, the fourth extending portion and the first branch form a first radiation portion of the multi-band antenna.

3. The multi-band antenna as claimed in claim 2, wherein the feed-in portion, the first extending portion, the second extending portion, the third extending portion, the fifth extending portion and the second branch form a second radiation portion of the multi-band antenna.

4. The multi-band antenna as claimed in claim 3, wherein the feed-in portion, the first extending portion, the second extending portion and the third branch form a third radiation portion of the multi-band antenna.

5. The multi-band antenna as claimed in claim 4, wherein an extending length of the first radiation portion is longer than an extending length of the second radiation portion, the extending length of the second radiation portion is longer than an extending length of the loop portion, the extending length of the loop portion is longer than an extending length of the third radiation portion.

6. The multi-band antenna as claimed in claim 1, wherein the first branch has a first transverse portion and a first upright portion, an upper portion of the front of the fourth extending portion extends frontward to form the first transverse portion, a rear end of the first transverse portion is connected with the upper portion of the front of the fourth extending portion, a front end of the first transverse portion extends downward to form the first upright portion, an extending direction of the first upright portion and an extending direction of the second branch are perpendicular to each other, the first upright portion and the second branch are spaced from each other.

7. The multi-band antenna as claimed in claim 6, wherein the third branch has a second upright portion, a second transverse portion and a linking portion, a top of the second extending portion extends upward to form the second upright portion, a bottom of the second upright portion is connected with the top of the second extending portion, a top of the second upright portion extends along a transverse direction to form the second transverse portion, a rear edge of the second transverse portion is in alignment with a rear edge of the lower grounding portion, a front of the second transverse portion is spaced from the fourth extending portion, a junction between a front edge of the second upright portion and a bottom edge of the second transverse portion protrudes frontward and downward to form the linking portion, the linking portion projects beyond the front edge of the second upright portion and the bottom edge of the second transverse portion, a top edge of the third branch is in alignment with the topmost edge of the first branch, the second upright portion is connected with a middle of the bottom edge of the second transverse portion.

8. The multi-band antenna as claimed in claim 1, wherein the loop portion has a first section, a second section, a third section, a fourth section and a fifth section, a lower portion of a front of the fifth extending portion extends frontward to form the first section, a front end of the first section extends downward to form the second section, a bottom end of the second section extends rearward to form the third section, a rear end of the third section extends upward to form the fourth section, a top end of the fourth section extends rearward to form the fifth section, a rear end of the fifth section is connected with the feed-in portion, the rear end of the fifth section is connected with an upper portion of the first end edge of the feed-in portion.

9. The multi-band antenna as claimed in claim 1, wherein a junction between the first extending portion and the second extending portion protrudes upward and frontward to form a first protruding portion, a front of the second extending portion, a bottom of the third extending portion, a top of the first protruding portion and the second side edge of the feed-in portion surround a first interval, the first protruding portion is located between a top of the first extending portion and the front of the second extending portion, the first interval is located among the feed-in portion, the first extending portion, the second extending portion, the third extending portion and the first protruding portion.

10. The multi-band antenna as claimed in claim 9, wherein a junction between the third extending portion and the fourth extending portion protrudes upward and rearward to form a second protruding portion, the second protruding portion is located between a top edge of the third extending portion and a rear edge of the fourth extending portion, the top edge of the third extending portion, the rear edge of the fourth extending portion, the second protruding portion and the third branch surround a second interval, the second interval is located among the third extending portion, the fourth extending portion, the second protruding portion and the third branch.

11. The multi-band antenna as claimed in claim 1, wherein a lower portion of a front of the fifth extending portion is connected with the upper end of the loop portion, the lower portion of the front of the fifth extending portion extends frontward, then extends downward, and further meanders rearward to form the loop portion, an upper portion of the first end edge of the feed-in portion is connected with the loop portion, a lower portion of the first end edge of the feed-in portion is connected with the upper grounding portion, the lower portion of the first end edge extends frontward to form the upper grounding portion, an upper portion of the second end edge of the feed-in portion is connected with the first extending portion, the upper portion of the second end edge extends rearward to form the first extending portion, the first side edge of the feed-in portion is adjacent to the lower grounding portion, the first side edge is spaced from the lower grounding portion, the feeding point is adjacent to the first side edge of the feed-in portion.

12. The multi-band antenna as claimed in claim 1, wherein a rear end of the upper grounding portion is connected with a lower portion of the first end edge of the feed-in portion, the upper grounding portion is parallel to the lower grounding portion, the upper grounding portion is located among the feed-in portion, the loop portion and the lower grounding portion, a front end of the upper grounding portion extends downward to form a connecting portion, a bottom end of the connecting portion is connected with the lower grounding portion, the connecting portion is a short narrow rectangle plate shape, the connecting portion is perpendicular to the upper grounding portion, the connecting portion is perpendicular to the lower grounding portion.

13. The multi-band antenna as claimed in claim 1, wherein an upper portion of the second end edge of the feed-in portion extends rearward to form the first extending portion, the first extending portion and the lower grounding portion are spaced from each other, the first extending portion is parallel to the lower grounding portion, a front end of the first extending portion is connected with the feed-in portion, a rear end of the first extending portion is connected with the second extending portion, the rear end of the first extending portion extends upward to form the second extending portion.

14. The multi-band antenna as claimed in claim 1, wherein a bottom of the second extending portion is located above the lower grounding portion, the second extending portion is perpendicular to the first extending portion, the bottom of the second extending portion is connected with a rear end of the first extending portion, a top of the second extending portion is connected with the third branch, an upper portion of a front of the second extending portion is connected with the third extending portion, the upper portion of the front of the second extending portion extends frontward to form the third extending portion.

15. The multi-band antenna as claimed in claim 1, wherein the third extending portion is parallel to the feed-in portion, the first extending portion and the lower grounding portion, a rear end of the third extending portion is connected with an upper portion of a front of the second extending portion, a front end of the third extending portion is connected with the fourth extending portion, the front end of the third extending portion extends upward to form the fourth extending portion, a topmost edge of the second extending portion is flush with a topmost edge of the third extending portion, a topmost edge of the fifth extending portion is flush with a topmost edge of the second branch, a topmost edge of the fourth extending portion is flush with a topmost edge of the first branch.

16. The multi-band antenna as claimed in claim 1, wherein a rear of the fifth extending portion is connected with the fourth extending portion, a lowest edge of the fifth extending portion is flush with a lowest edge of the third extending portion, the fifth extending portion is parallel to the feed-in portion, the first extending portion, a rear of the first branch and the lower grounding portion, an upper portion of a front of the fifth extending portion is connected with the second branch, the upper portion of the front of the fifth extending portion extends frontward to form the second branch, a lower portion of the front of the fifth extending portion is connected with the upper end of the loop portion, the lower portion of the front of the fifth extending portion extends frontward, then extends downward, and further meanders rearward to form the loop portion.

17. The multi-band antenna as claimed in claim 1, wherein a rear of the first branch is connected with an upper portion of the front of the fourth extending portion, an upper portion of the first branch is parallel to the feed-in portion and the lower grounding portion, a rear end of the second branch is connected with an upper portion of a front of the fifth extending portion, the upper portion of the front of the fifth extending portion extends frontward to form the second branch, the second branch is parallel to the feed-in portion and the lower grounding portion, the second branch is a rectangular bar shape and extends along a transverse direction, the second branch is located among the first branch, the fifth extending portion and the loop portion, a front end of the second branch is free.

18. The multi-band antenna as claimed in claim 1, wherein a bottom of the third branch is connected with a top of the second extending portion, the top of the second extending portion extends upward, and then extends along a transverse direction to form the third branch, an upper portion of the third branch is parallel to the feed-in portion and the lower grounding portion, the third branch is a T shape, a top edge of the third branch is in alignment with the topmost edge of the first branch.

19. A multi-band antenna, comprising:

a lower grounding portion;

a feed-in portion having a first end edge, a second end edge opposite to the first end edge, a first side edge, and a second side edge opposite to the first side edge, the first side edge being adjacent to the lower grounding portion, the first side edge being spaced from the lower grounding portion;

a feeding point disposed to the feed-in portion, the feeding point being adjacent to the first side edge;

an upper grounding portion, a lower portion of the first end edge of the feed-in portion extending frontward to form the upper grounding portion, the upper grounding portion being electrically connected between the feed-in portion and the lower grounding portion;

a first extending portion, an upper portion of the second end edge of the feed-in portion extending rearward to form the first extending portion;

a second extending portion, a rear end of the first extending portion extending upward to form the second extending portion;

a third extending portion, an upper portion of a front of the second extending portion extending frontward to form the third extending portion;

a fourth extending portion, a front end of the third extending portion extending upward to form the fourth extending portion;

a fifth extending portion, the front end of the third extending portion extending frontward to form the fifth extending portion;

a first branch, an upper portion of a front of the fourth extending portion extending frontward to form the first branch;

a second branch, an upper portion of a front of the fifth extending portion extending frontward to form the second branch;

a third branch, a top of the second extending portion extending upward, and then extending along a transverse direction to form the third branch; and a loop portion, a lower portion of the front of the fifth extending portion extending frontward, then extending downward, and further meandering rearward to form the loop portion, a lower end of the loop portion being connected with the first end edge of the feed-in portion;

wherein the feed-in portion, the first extending portion, the second extending portion, the third extending portion, the fourth extending portion and the first branch form a first radiation portion;

wherein the feed-in portion, the first extending portion, the second extending portion, the third extending portion, the fifth extending portion and the second branch form a second radiation portion; and wherein the feed-in portion, the first extending portion, the second extending portion and the third branch form a third radiation portion.

20. A multi-band antenna, comprising:

a lower grounding portion;

a feed-in portion extending along a transverse direction, the feed-in portion being spaced from the lower grounding portion;

a feeding point disposed to the feed-in portion;

an upper grounding portion, being electrically connected between the feed-in portion and the lower grounding portion;

a first extending portion being extended from one edge of the feed-in portion;

a second extending portion being extended from the first extending portion;

a third extending portion being extended from the second extending portion;

a fourth extending portion being extended from the third extending portion;

a fifth extending portion being extended from the third extending portion;

a first branch being extended from the fourth extending portion;

a second branch being extended from the fifth extending portion;

a third branch being extended from the second extending portion; and a loop portion being connected between the fifth extending portion and the feed-in portion;

wherein the feed-in portion, the first extending portion, the second extending portion, the third extending portion, the fourth extending portion and the first branch form a first radiation portion;

wherein the feed-in portion, the first extending portion, the second extending portion, the third extending portion, the fifth extending portion and the second branch form a second radiation portion; and wherein the feed-in portion, the first extending portion, the second extending portion and the third branch form a third radiation portion.

* * * * *